United States Patent [19]

Sakaida

[11] Patent Number: 4,473,311

[45] Date of Patent: Sep. 25, 1984

[54] PRINT WIRE DRIVE ASSEMBLY FOR DOT-MATRIX PRINTERS

[75] Inventor: Atsuo Sakaida, Nagoya, Japan

[73] Assignee: Brother Kogyo Kabushiki Kaisha, Nagoya, Japan

[21] Appl. No.: 477,030

[22] Filed: Mar. 21, 1983

[30] Foreign Application Priority Data

Mar. 31, 1982 [JP] Japan ..... 57-52765

[51] Int. Cl.[3] ..... B41J 3/12; B41J 9/38

[52] U.S. Cl. ..... 400/124; 101/93.05; 400/157.2

[58] Field of Search ..... 400/121, 124, 157.2; 101/93.04, 93.05

[56] References Cited

U.S. PATENT DOCUMENTS 4,394,093 7/1983 Asano et al. ..... 400/124

FOREIGN PATENT DOCUMENTS 2334298 1/1974 Fed. Rep. of Germany ..... 400/124

2103443 2/1983 United Kingdom ..... 400/124

*Primary Examiner*—Paul T. Sewell

*Attorney, Agent, or Firm*—Browdy and Neimark

[57] ABSTRACT

A print wire drive assembly for a dot-matrix printer having a plurality of solenoids selectively driving print wires. The solenoids are disposed, in plural groups which are not energized simultaneously, such that at least one solenoid of one group is disposed so adjacent to a solenoid of another group that the two solenoids are mutually inductive. The drive assembly comprises a solenoid drive circuit including first and second connection lines by which high- and low-level terminals of one of the two adjacent solenoids are connected to low- and high-level terminals of the other of the adjacent solenoids, respectively. At least one of the first and second connection lines includes a rectifying element which allows a current flow through the connection line in one direction from the low-level terminal to the high-level terminal when a reverse voltage is produced between the high- and low-level terminals of one of the adjacent solenoids upon deenergization thereof immediately before energization of the other solenoid.

10 Claims, 6 Drawing Figures

PRINT WIRE DRIVE ASSEMBLY FOR DOT-MATRIX PRINTERS

BACKGROUND OF THE INVENTION

The present invention relates to a print wire drive assembly for a dot-matrix printer having a plurality of print wires selectively driven by a plurality of corresponding electromagnetic solenoids to impact a printing surface for impression of characters on the printing surface.

In the art of a print wire drive assembly of such type, at least a pair of solenoids are disposed adjacent to each other to the extent that the two solenoids are mutually inductive. It is generally recognized, in this instance, that an undesirable condition will arise when one of the solenoids is energized immediately or a very short time interval after the other solenoid has been deenergized as in producing a half-dot impression. More specifically, upon energization of one solenoid while a magnetic flux of the other solenoid is disappearing after deenergization thereof, said one solenoid is subject to a poor rise of current and a consequent insufficient energization thereof whereby an impact of a print wire corresponding to that solenoid is reduced with a result of unclear printing or printing failure.

SUMMARY OF THE INVENTION

It is accordingly an object of the present invention to provide a print wire drive assembly for a dot-matrix printer including two mutually inductive adjacent solenoids one of which is energized immediately after the other has been deenergized, which drive assembly assures a sufficient energization of the solenoids activated one after the other.

According to the present invention, there is provided a print wire drive assembly for a dot-matrix printer having a plurality of print wires selectively driven to impact a printing surface for impression of characters on the printing surface. The print wire drive assembly comprises a plurality of electromagnetic solenoids provided, in a plurality of groups which are not energized simultaneously, to drive corresponding plural groups of the print wires. At least one of the solenoids of one group is spaced from at least one solenoid of another group adjacent to the one group by a distance shorter than a distance by which any one of the other solenoids of said one group is spaced from any one of the other solenoids of said another group. The print wire drive assembly of the invention further comprises a solenoid drive circuit including a first connection line by which a high-level terminal of said at least one solenoid of said one group is connected to a low-level terminal of said at least one solenoid of said another group and a second connection line by which a low-level terminal of said at least one solenoid of said one group is connected to a high-level terminal of said at least one solenoid of said another group, at least one of said first and second connection lines comprising a rectifying element allowing a current flow from said low-level terminal to said high-level terminal through the connection line while inhibiting a current flow therethrough from said high-level terminal to said low-level terminal. Said first and second connection lines supply to said at least one solenoid of said one group a current which is generated owing to a back electromotive force of said at least one solenoid of said another group when said at least one solenoid of said one group is energized immediately after said at least one solenoid of said another group has been deenergized. The current partly energizes said at least one solenoid of said one group to the extent that will not cause the respective print wire to be driven.

In the print wire drive assembly constructed according to the invention as described above, a residual energy of a solenoid owing to the back electromotive force upon deenergization thereof is applied, through connection lines including at least one rectifying element, to an adjacent solenoid which is energized immediately after said one solenoid has been deenergized. The application of the residual energy permits the subsequently activated one of the solenoids to be partly energized in a direction to eliminate an effect of mutual induction of the two adjacent solenoids, and to the extent that will not cause the respective print wire to be driven, whereby the subsequently activated solenoid is smoothly energized with a fast rise of current and the print wire is driven without otherwise possible reduction in impact pressure thereby assuring a clear impression on an impacting surface.

BRIEF DESCRIPTION OF THE DRAWING

The above and other objects, features and advantages of the present invention will become more apparent from reading the following description of the preferred embodiment taken in connection with the accompanying drawings in which.

DETAILED DESCRIPTION OF THE PREFERRED EMBODIMENT

Figure 1:
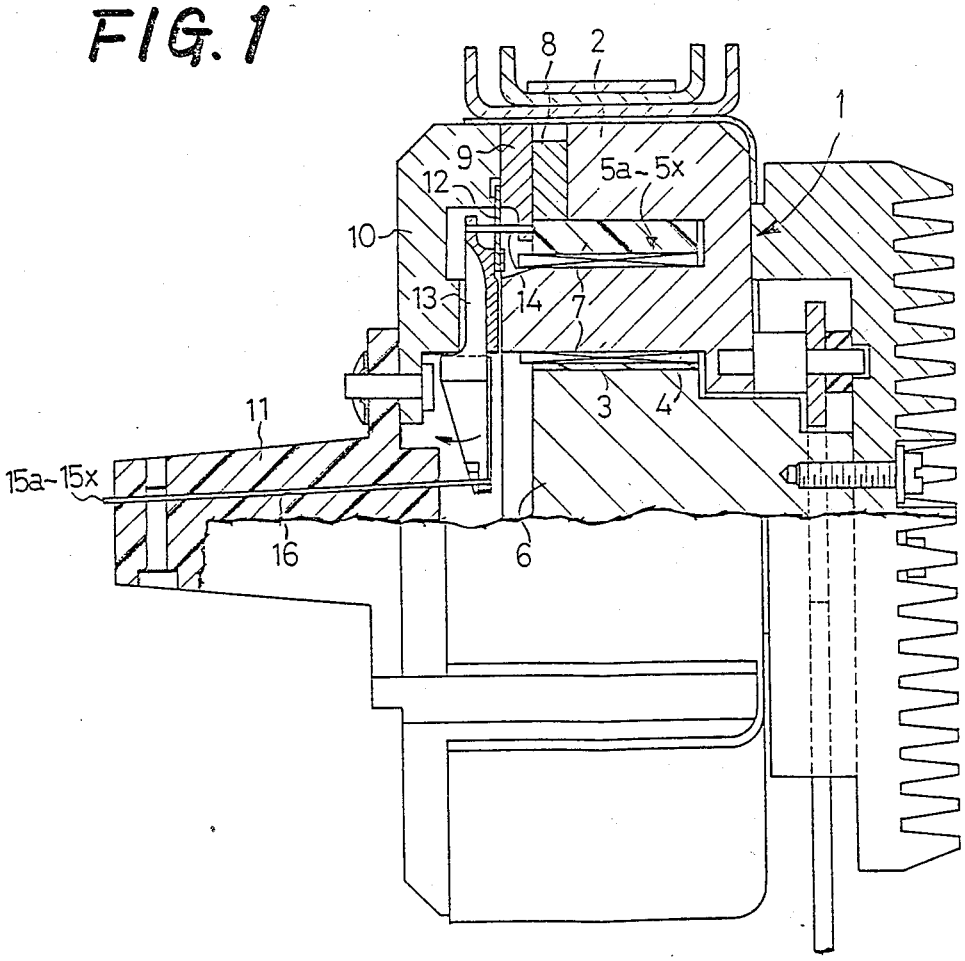
FIG. 1 is a side elevational view of a print head for a dot-matrix printer, partly broken away to show the interior in cross section.
Figure 2:
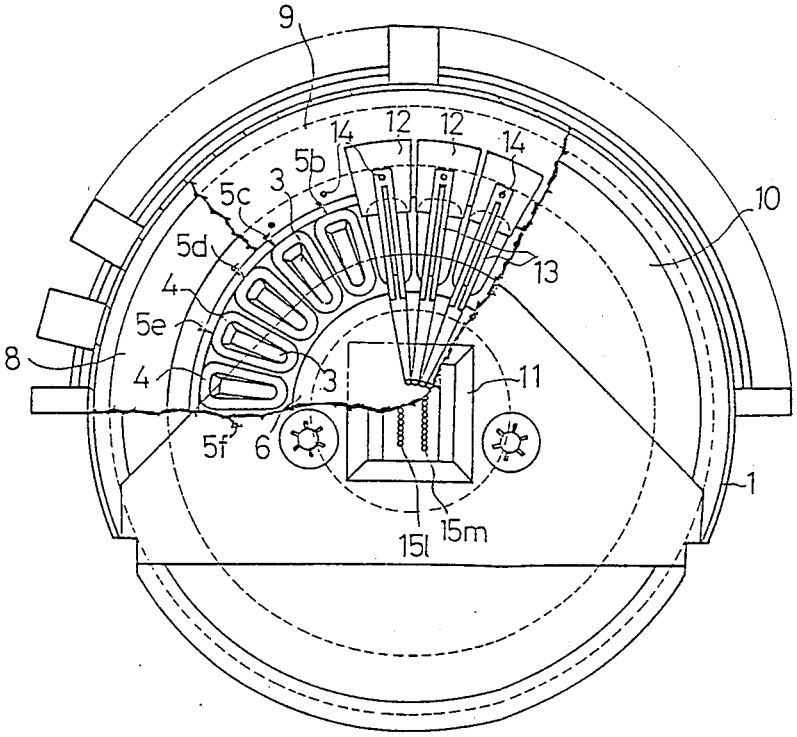
FIG. 2 is a front elevation of the print head of FIG. 1, partly broken away to show the interior thereof.
Figure 3:
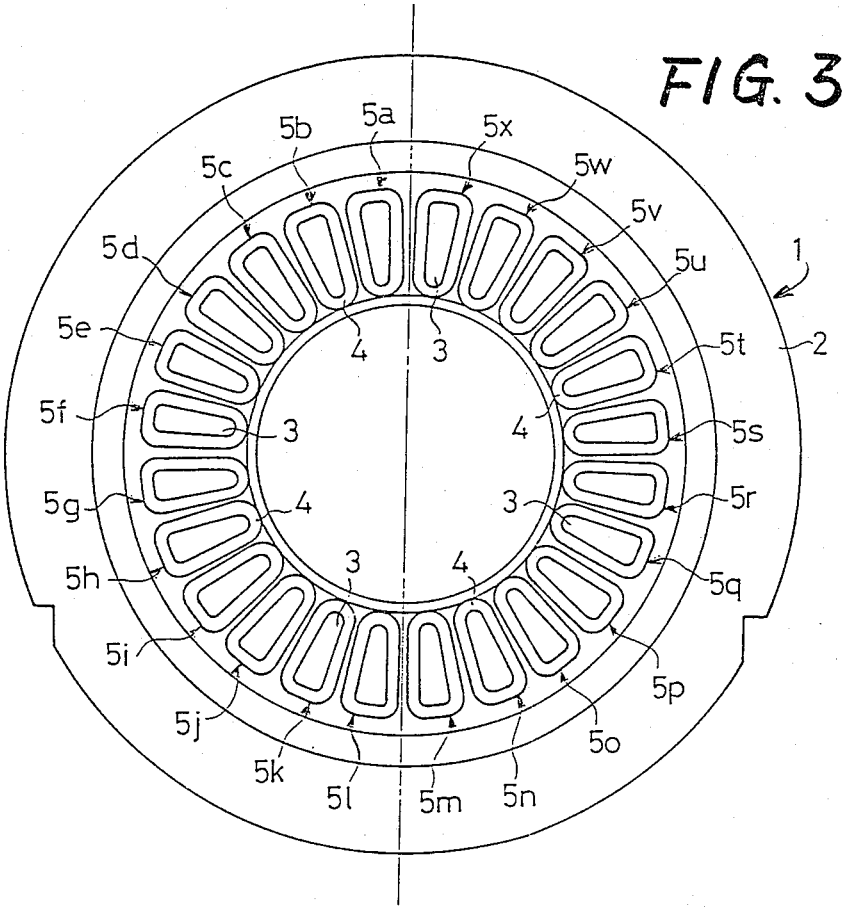
FIG. 3 is a front elevation of the print head, illustrating an arrangement of electromagnetic solenoids.

Referring to FIGS. 1 and 2, there is illustrated a print head for a dot-matrix printer. The print head includes an annular magnetic body 1 disposed on the rear side (on the right side as viewed in FIG. 1) of the print head, which magnetic body 1 has an annular yoke portion 2 and twenty-four cores 3 formed integrally with the magnetic body 1. As shown in FIGS. 2 and 3, the cores 3 are disposed radially internally of the yoke portion 2 so as to provide a circular array of the cores in equally spaced relation with one another. A coil 4 is wound around each of the cores 3 so that each combination of the core 3 and coil 4 constitutes an electromagnetic solenoid 5. Thus, a total of twenty-four electromagnetic solenoids **5*a*–5*x* are provided in the form of a circular array concentric with the periphery of the yoke portion 2 or annular magnetic body 1. For reduced size of the print head, these solenoids 5*a*–5*x* are disposed adjacent to one another to the extent that they are mutually inductive. In the central part of the annular magnetic body 1 is provided a heat sink member 6 for allowing radiation of heat which is produced upon energization of the coils 4. There are provided, between the heat sink member 6 and the coil 4 and between the coil 4** and the yoke portion 2, thermally conductive members 7 of synthetic resin material having a high thermal conductivity.

To a front annular surface of the yoke portion 2 is secured a permanent magnet 8 of annular configuration which in turn has a front annular surface to which is secured an annular armature support member 9 of magnetic material. A front covering member 10 of magnetic material is secured to a front surface of the armature support member 9 to cover the print head on its front side. The front covering member 10 is provided, at its central portion, with a wire guiding nose member 11 secured thereto. While the solenoid 5 is in the non-energized position, there is formed by the permanent magnet 8 a magnetic flux passing the yoke portion 2, core 3, front covering member 10 and armature support member 9. Energization of the coil 4 produces a magnetic flux which cancels the flux of the permanent magnet 8.

Twenty-four armatures 13 of magnetic material are provided corresponding to the respective solenoids 5*a*–5*x*. The armatures 13 are connected at one end thereof to the armature support member 9 by means of corresponding twenty-four pairs of leaf springs 12 and wire springs 14. Each leaf spring 12 is connected at one end thereof to the front annular surface of the armature support member 9 and at the other end to said one end of the armature 13. The leaf spring 12 has a small aperture through its thickness. The wire spring 14 extends through this aperture in crossed relation with the leaf spring 12 such that opposite ends of the wire are secured to the armature 13 and the armature support member 9 respectively. While each armature 13 is biased by those springs 12 and 13 in a direction away from the face of the core 3, the armature 13 is kept in contact with the face of the core 3 by magnetic attraction of the permanent magnet 8 which overcomes resilient forces of the leaf and wire springs 12 and 14 while the solenoids 5 are placed in the non-energized position. When one of the coils 4 is selectively energized and the magnetic flux by the permanent magnet 8 is cancelled, the corresponding armature 13 is released from the magnetic attraction and pivoted, with the biasing forces of the springs 12 and 14, about its said one end away from the face of the core 3, i.e., toward the front of the print head.

Figure 4:
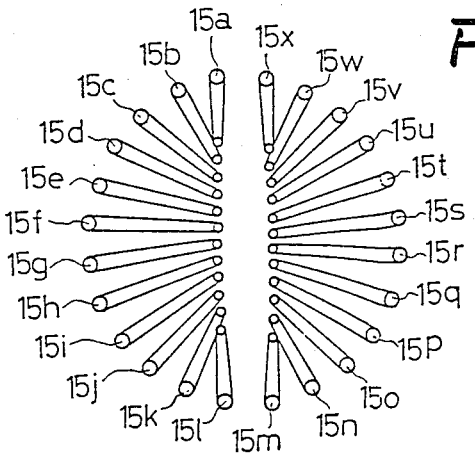
FIG. 4 is a schematic illustration representing an arrangement of print wires.

Print wires 15*a*–15*x* are fixed to the other end of the respective armatures 13. Each wire extends through a guide hole 16 which is formed through the wire guiding nose member 11. Thus, the release of the selected armature 13 away from the core 3 will cause the corresponding print wire 15 to project at its free end out of the nose member 11 thereby impacting a printing surface for an intended printing operation. As indicated in FIGS. 2 and 4, the guide holes 16 are formed in the nose member 11 such that their openings at the front end of the member 11 are disposed in two parallel rows, right and left, each consisting of twelve openings which correspond to the free ends of the print wires located in right or left half of the print head as seen in FIG. 4. More specifically, the free ends of the print wires 15*a*–15l corresponding to the solenoids 5*a*–5*l* located in the left half are arranged on the left row while those of the print wires 15*m*–15*x* corresponding to the solenoids 5*m*–5*x* in the right half are located on the right row, as seen in FIGS. 3 and 4. In this specific print head, it is designed that the solenoids 15*a*–15*l* of one group on the left-hand side are not energized simultaneously with the solenoids 15*m*–15*x* of another group on the right-hand side.

Figure 5:
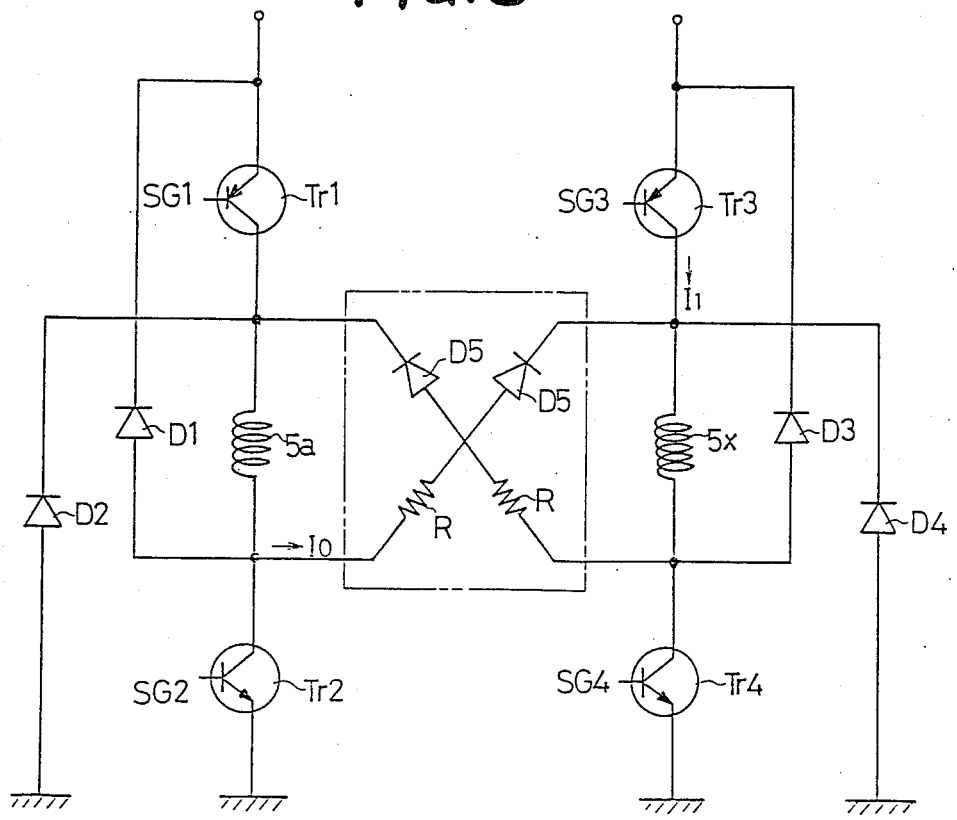
FIG. 5 is a diagram showing an electric circuit for driving the solenoids.

Referring next to FIG. 5, there is provided a description of an electric circuit for driving each electromagnetic solenoid 5 used in the print head of armature-release type constructed as described hereinabove.

The description of drive circuits for the solenoids 5*b*–5*k* and 5*n*–5*w*, which are known circuits, is omitted herein because, in this specific embodiment, the connection circuits according to the present invention is provided only for the two pairs of the adjacent solenoids belonging to the respective right and left groups, which are not energized simultaneously, i.e., 5*a* and 5*x* as one pair, and 5*l* and 5*m* as another pair.

For convenience, the following description refers only to the drive circuit for the pair of solenoids 5*a* and 5*x* because the drive circuit for the other pair of solenoids 5*l* and 5*m* are substantially identical to that for the solenoids 5*a* and 5*x*.

As shown in FIG. 5, the electromagnetic solenoid 5*a* is connected at opposite high- and low-level terminals to transistors Tr1 and Tr2 for switching purpose, respectively. The switching transistor Tr1 is provided in a high-level line connected to the high-level terminal of the solenoid 5*a* and the switching transistor Tr2 in a low-level line connected to the low-level terminal of the solenoid 5*a*. Diodes D1 and D2 which are provided for a flywheel effect, are connected in parallel to a series circuit including the solenoid 5*a* and the transistor Tr1, and to a series circuit including the solenoid 5*a* and the transistor Tr2, respectively. Upon application of control signals SG1 and SG2 to bases of the respective transistors Tr1 and Tr2, the transistors are turned on and the solenoid 5*a* is thus energized.

In a similar way, the electromagnetic solenoid 5*x* is connected at opposite high- and low-level terminals to switching transistors Tr3 and Tr4, respectively, and flywheel diodes D3 and D4 are connected in parallel to a series circuit including the solenoid 5*x* and the transistor Tr3, and to a series circuit including the solenoid 5*x* and the transistor Tr4, respectively. When the transistors Tr3 and Tr4 are turned on with control signals SG3 and SG4 being applied to their bases, the solenoid 5*x* is energized.

As is apparent from the foregoing description, provisions are made for generating the control signals SG1–SG4 such that one pair of the transistors Tr3 and Tr4 are off while the other pair Tr1 and Tr2 are in the on-position, or vice versa, namely, the transistors Tr1 and Tr2 are off while the transistors Tr3 and Tr4 are in the on-position.

There are connected, between a collector of the transistor Tr2 and an emitter of the transistor Tr3, a diode D5 and a resistor R in series with the diode D5. In other words, a series combination of the diode D5 and the resistor R is provided in a first connection line which connects the low-level terminal of the solenoid 5*a* to the high-level terminal of the solenoid 5*x*. Similarly, another combination of diode D5 and resistor R in series connection is connected between a collector of the transistor Tr4 and an emitter of the transistor Tr1, i.e., in a second connection line which connects the high-level terminal of the solenoid 5*a* to the low-level terminal of the solenoid 5*x*. These first and second connection lines including the diodes D5 are provided so that a residual energy upon deenergization of the solenoid 5*a* is supplied to the solenoid 5*x* and so that a residual energy upon deenergization of the solenoid 5*x* is applied to the solenoid 5*a*. The resistors R are used to adjust values of current flow through the solenoids 5*a* and 5*x* incident to the residual energy supply so that the solenoid 5a or 5x is partly energized by the residual energy in a direction to eliminate an effect of mutual magnetic induction of the two adjacent solenoids 5a and 5x, and to such extent that will not cause the corresponding armature 13 to pivot away from the face of the core 3. Put in the other way, the values of resistance of the resistors R are suitably determined such that the print wire 15a or 15x is driven in the same manner as if it was activated by any of the solenoids other than 5a, 5x, 5l and 5m.

The operation of the drive circuit for the adjacent solenoids 5a and 5x is described below.

Figure 6:
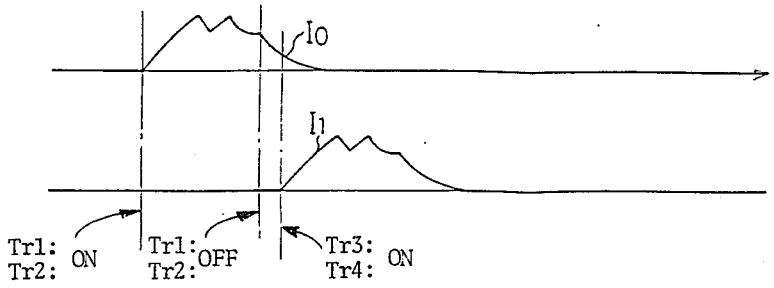
FIG. 6 is a waveform chart representing waveforms of current flowing through the solenoids.

When the transistors Tr1 and Tr2 are turned off while the solenoid 5a is being energized, a current flow through the solenoid 5a is cut off and a back electromotive force is produced across the solenoid 5a, i.e., between the opposite terminals thereof. This back electromotive force causes a current $I_o$, as indicated in FIG. 6, to flow through the solenoid 5x via the diodes D5 and the resistors R, whereby the solenoid 5x is partly energized to the extent that will not cause the corresponding armature 13 to be released from the face of the core 3. Upon the transistors Tr3 and Tr4 turned on while the solenoid 5x is partly energized as described above, a current $I_1$ (as indicated in FIG. 6) flows via the transistor Tr3 through the solenoid 5x which has been already partly energized. As a result, a sufficient energization of the solenoid 5x and a quick release of the armature 13 are achieved upon turning on the transistors Tr3 and Tr4 whereby the corresponding print wire is driven in smooth and fast fashion without otherwise possible reduction in impact pressure thereof against a printing surface.

While the solenoid drive circuit according to the invention is used only for two pairs of neighboring solenoids 5a and 5x, and 5l and 5m in the above embodiment, the drive circuit applicable to other solenoids which are disposed in relatively close proximity to each other and which are energized sequentially with a short period of time delay. In this instance, too, the rise of a subsequently energized solenoid or solenoids is improved.

Further, the solenoids which are disposed in two groups along a circle in the foregoing embodiment, may be divided into three or more groups which are not activated simultaneously, and the drive circuit of the invention is applicable to mutually adjacent or neighboring ones of such solenoids as long as they belong to different groups.

Although the solenoid drive circuit described above in association with the foregoing embodiment uses two diodes D5 as rectifying elements, one in the first connection line and the other in the second connection line, it is possible that only one of the first and second connection lines includes a rectifying element which is not limited to a diode, provided the element allows a current flow from a low-level terminal of a solenoid to a high-level terminal of another solenoid and inhibits a current flow in the reverse direction.

The solenoids 5a through 5x referred to above in the preferred form of the present invention are used for cancelling a magnetic force of a permanent magnet upon energization thereof to release the armatures from attraction by the magnetic force which normally keeps the print wires at their rest position. However, the print wire drive assembly of the invention may be of a type wherein the armatures and the print wires are moved to their operated position through attraction of the armatures to the magnetic cores by the solenoids upon energization thereof.

Obviously, other modifications and variations of the present invention are possible to those skilled in the art in the light of the above teachings. It is therefore to be understood that within the scope of the appended claims the invention may be practiced otherwise than specifically described.

What is claimed is:

1. A print wire drive assembly for a dot-matrix printer having a plurality of print wires selectively driven to impact a printing surface for impression of characters on the printing surface, said print wire drive assembly comprising:

a plurality of electromagnetic solenoids provided, in a plurality of groups which are not energized simultaneously, to drive corresponding plural groups of said print wires, at least one of said solenoids of one of said groups being spaced from at least one of said solenoids of another group adjacent said one group by a distance shorter than a distance by which any of the other solenoids of said one group is spaced from any of the other solenoids of said another group; and a solenoid drive circuit including a first connection line by which a high-level terminal of said at least one solenoid of said one group is connected to a low-level terminal of said at least one solenoid of said another group, and a second connection line by which a low-level terminal of said at least one solenoid of said one group is connected to a high-level terminal of said at least one solenoid of said another group, at least one of said first and second connection lines comprising a rectifying element allowing a current flow from said low-level terminal to said high-level terminal through the connection line while inhibiting a current flow therethrough from said high-level terminal to said low-level terminal, said connection lines supplying to said at least one solenoid of said one group a current which is generated owing to a back electromotive force of said at least one solenoid of said another group when said at least one solenoid of said one group is energized immediately after said at least one solenoid of said another group has been deenergized, said current partly energizing said at least one solenoid of said one group to the extent that will not cause the respective print wire to be driven.

2. A print wire drive assembly as recited in claim 1, wherein said at least one connection line comprises a resistor for adjusting said current owing to the back electromotive force to a suitable level that will not cause the print wire to be driven.

3. A print wire drive assembly as recited in claim 1, wherein said rectifying element comprises a diode.

4. A print wire drive assembly as recited in claim 1, wherein each of said first and second connection lines comprises said rectifying element and a resistor connected in series with said rectifying element, said resistor adjusting said current owing to the back electromotive force to a suitable level that will not cause the print wire to be driven.

5. A print wire drive assembly as recited in claim 4, wherein said rectifying element comprises a diode.

6. A print wire drive assembly as recited in claim 1, wherein said solenoid drive circuit comprises a switching transistor provided in a high-level line connected to said high-level terminal of said at least one solenoid and another switching transistor provided in a low-level line connected to said low-level terminal.

7. A print wire drive assembly as recited in claim 1, wherein said plurality of groups of solenoids are disposed along corresponding circular arcs of a circle, said at least one solenoid of said one group and said at least one solenoid of said another group being disposed at ends of said circular arcs which are adjacent to each other.

8. A print wire drive assembly as recited in claim 1, wherein said plurality of solenoids are provided in two groups and disposed in equally spaced relation with each other, a first group along one circular arc of a circle and a second group along another circular arc cooperating with said one circular arc to form said circle, said at least one solenoid of said one group comprising two solenoids at opposite ends of said one circular arc, and said at least one solenoid of said another group comprising two solenoids at opposite ends of said another circular arc, thereby providing two pairs of solenoids each driven by said solenoid drive circuit.

9. A print wire drive assembly as recited in claim 1, wherein said print wires are moved to their operated position through cancelling, by said solenoids upon energization thereof, of a magnetic force of a permanent magnet which normally keeps said print wires at their rest position.

10. A print wire drive assembly as recited in claim 1, wherein said print wires are moved to their operated position through attraction thereof by said solenoids upon energization.

* * * * *